US005201826A

United States Patent [19]

Zimmermann

[11] Patent Number: 5,201,826

[45] Date of Patent: Apr. 13, 1993

[54] APPARATUS FOR SECURING ARTICLES IN AN AUTOMATIC DISHWASHER

[76] Inventor: Dayton E. Zimmermann, 2600 SW. Freeway, Ste. 415, Houston, Tex. 77098

[21] Appl. No.: 774,588

[22] Filed: Oct. 10, 1991

[51] Int. Cl.[5] ..... A47F 5/00

[52] U.S. Cl. ..... 211/41; 248/499

[58] Field of Search ..... 211/41, 119.1, 119.13, 211/119.01, 181; 248/499, 500, 505; 134/135, 201; 160/329, 354, 368.1; 24/90 B, 453

[56] References Cited

U.S. PATENT DOCUMENTS

| | | | |
|---|---|---|---|
| 3,289,854 | 12/1966 | Kauffman | 211/41 |
| 3,616,806 | 11/1971 | Randall | 134/168 R |
| 3,871,089 | 3/1975 | Kunz | 24/90 B |
| 4,006,950 | 2/1977 | Murray | 312/270.1 |
| 4,635,799 | 1/1987 | Penner | 211/41 |
| 4,748,993 | 6/1988 | Llewellyn | 234/201 X |
| 4,832,206 | 5/1989 | Cunningham | 211/41 |
| 4,893,668 | 1/1990 | Nomura | 160/368.1 X |
| 4,974,806 | 12/1990 | Matern | 211/41 X |
| 5,114,019 | 5/1992 | Sandbank | 211/41 |
| 5,121,843 | 6/1992 | Elder | 211/41 |

*Primary Examiner*—Carl D. Friedman
*Assistant Examiner*—Derek J. Berger
*Attorney, Agent, or Firm*—Head and Johnson

[57] ABSTRACT

An apparatus for use with an open top generally rectangular wire basket as used in domestic automatic dishwashers in which the wire basket has a front and back, and opposed sides with a bottom formed of crossed, generally paralleled wire members, the basket being configured to receive food preparation and serving articles therein for washing as water is sprayed upwardly through the basket in a dishwasher, the basket having an open top defined by an upper circumferential periphery of wire construction, the apparatus comprising a generally rectangular flexible open mesh member having a peripheral edge therearound, a border member secured to the open mesh member peripheral edge having a contracted circumferential length and an expandable circumferential length, and T-pin member removable attachable to the basket bottom forming wire for restraining the mesh member against upward dislodgment to thereby more effectively retain food preparation and serving articles in the basket against the spray of water during washing action.

13 Claims, 2 Drawing Sheets

APPARATUS FOR SECURING ARTICLES IN AN AUTOMATIC DISHWASHER

BACKGROUND OF THE DISCLOSURE

Automatic dishwashers provide a fast and efficient means of cleaning kitchen or other types of wares. The typical modern dishwasher has at least one pressurized water jet for cleaning dishes and the like. The amount of pressure needed to extract particles from the objects to be cleaned is substantial. A large number of food preparation and severing articles are made of a plastic or other lightweight material. A problem arises when these lightweight articles are placed upside down for cleaning within a domestic automatic dishwasher. The high water pressure from the water jets causes the lightweight food preparation and severing articles to become dislodged from their upside down position and thereby retain water and remain unclean.

Other have provided means for holding articles in a dishwasher rack and for reference to such devices see the following U.S. Pat. Nos. 955,231; 2,206,174; 2,233,725; 2,237,361; 2,508,491; 2,899,079; 3,289,854; 3,613,285; 3,901,728; 4,006,950; 4,434,898; 4,635,799; 4,748,993, and 4,832,206.

U.S. Pat. No. 4,832,206 issued to Cunningham and entitled "Article Holding Device For Dishwashers" provides a flexible mesh member in the shape of a rectangle for holding articles in place in a dishwasher and dimensioned to overlie at least a portion of the bottom of the rack and extends substantially across the space between the ends. The mesh member is attached at opposite ends to rigid plastic connector bars which may be placed on the outside of the dishwasher rack.

The present disclosure relates to an apparatus for holding food preparation and serving articles in their proper position within a dishwasher open top basket wherein the device is a substantially rectangular flexible mesh member with an outer edge having means thereon for attaching to the dishwasher rack. Applicant's disclosure herein does not require addition connector members, such as bars or the like, for securing to a dishwasher rack. Applicant provides a flexible member dimensioned to cover substantially the entire top of the dishwasher basket.

An object of this disclosure is to provide means of retaining food preparation and serving articles in an automatic dishwasher in their desired position.

SUMMARY OF THE DISCLOSURE

This disclosure relates to an apparatus for holding food preparation and serving articles in their proper position within an open top, generally rectangular wire basket as used in domestic automatic dishwashers having pressurized water jets. The dishwasher wire basket has a front and back, and opposed sides with a bottom formed of crossed, generally paralleled wire members. The basket is configured to received food preparation and serving articles therein, such as cups, glasses, bowls, saucers and the like, for washing as pressurized water is sprayed from water jets upwardly through the basket. The open top of the basket is defined by an upper circumferential periphery of wire construction. The articles to be cleaned, such glasses, bowls, saucers, dishes and the like, are placed in the dishwasher basket in an upside down position for cleaning by the pressurized water jets. Today many food preparation and serving articles are made of lightweight material or plastic and therefore are easily turned upright by the pressurized water jets and retain water therein. The apparatus of this disclosure provides means of securing the articles to be cleaned in their desired position within a domestic automatic dishwasher open top wire basket.

The apparatus of this disclosure is formed of generally rectangular flexible lightweight open mesh member, such as lightweight nylon or the like. The flexible mesh member has a peripheral edge therearound. Affixed to the peripheral edge is a border member having a contracted circumferential length and an expandable circumferential length. The contracted circumferential length is less than the length of the upper circumferential peripheral of the dishwasher basket. The expandable circumferential length is greater than the length of the upper circumferential peripheral of the dishwasher basket. The bolder member may be placed around and secured to the exterior of the basket upper circumferential periphery to retain said open mesh member and to fully close the basket open top whereby food preparation and serving articles are retained in the basket against the force of water sprayed through the basket.

Dishwashers provide means for cleaning various size articles. When the mesh member covers a dishwasher basket with smaller articles, such as bowls, and larger articles therein, such as glasses, the smaller articles may become dislodged from their desired position by the pressurized water jets. To prevent theses smaller items from turning upright or becoming dislodged, T-pin members are provided having an elongated slender body portion with an upper end and a lower end. An integral slender elongated cross-member is affixed to the upper and extracting normal to the body portion. Attachment means at the body portion lower end of provided for removably attaching to the dishwasher basket bottom wire members.

When in use the body portion of the T-pin member is extended through an opening in the flexible open mesh member with the attachment means secured to the basket bottom forming wire member. The cross-member serves to downwardly restrain the open mesh member against upward dislodgement to thereby more effectively retain food preparation and severing articles in the basket against the spray of water during the washing action. T-pin members provide a selectable means of further securing items in an automatic dishwasher basket.

T-pin members are varying length to accommodate the varying sized food preparation and serving articles which require cleaning in an automatic dishwasher.

A better understanding of the disclosure will be had by reference to the following description and claims, taken in conjunction with the attached drawings.

DESCRIPTION OF THE PREFERRED EMBODIMENT

Figure 1:
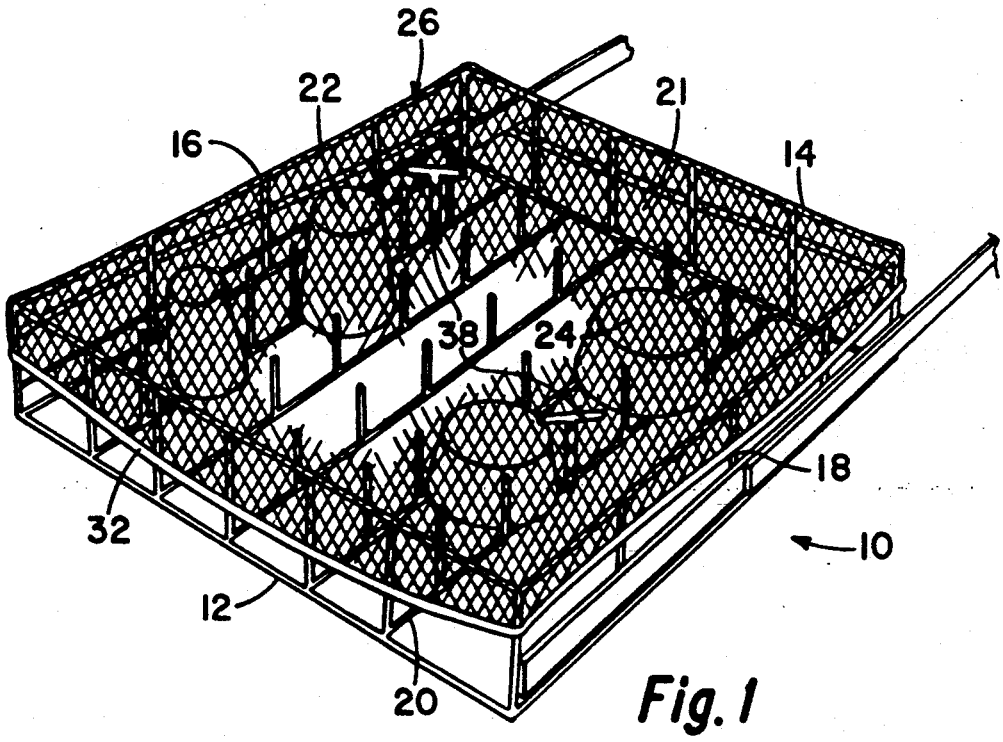
FIG. 1 is an elevational view of a dishwasher basket having the flexible open mesh member of this disclosure stretched over the open top thereof and showing the use of the T-pins members for selectively securing articles in their proper position.

Referring to the drawings and first to FIG. 1, a dishwasher basket, generally indicated by the numeral 10, is shown having a front 12, a back 14, opposed sides 16 and 18, a bottom end formed of crossed, generally paralleled wire members 20, and an open top 21 defined by an upper circumferential periphery of wire construction. Positioned on wire members 20 are soiled glasses 22 and bowls 24. Glasses 22 and bowls 24 are placed in basket 10 in the upside down position for cleaning by the dishwasher water jets (not shown).

Stretched across basket open top 21 is a generally rectangular flexible open mesh member 26. Mesh member 26 is dimensioned substantially to correspond to the upper circumferential periphery of the automatic dishwasher basket 10. Mesh member 26 has a peripheral edge 30 therearound. Secured to open mesh member peripheral edge 30 is a border member 32. Border member 32 has a contracted circumferential length and an expandable circumferential length. The contracted circumferential length is less than the length of upper circumferential surface periphery of the automatic dishwasher basket 10. The expandable circumferential length is greater than the length of the upper circumferential periphery of the automatic dishwasher basket 10. Border member 32 may be formed of elastic material or the like.

Referring to FIG. 1, when in use mesh member 26 is positioned over open top 21, glasses 22 and bowls 24 and border member 32 is stretched around and secured to the exterior of basket 10 upper circumferential periphery thereby retaining open mesh member 26, bowls 24 and glasses 22 and fully closing basket open top 21.

Figure 2:
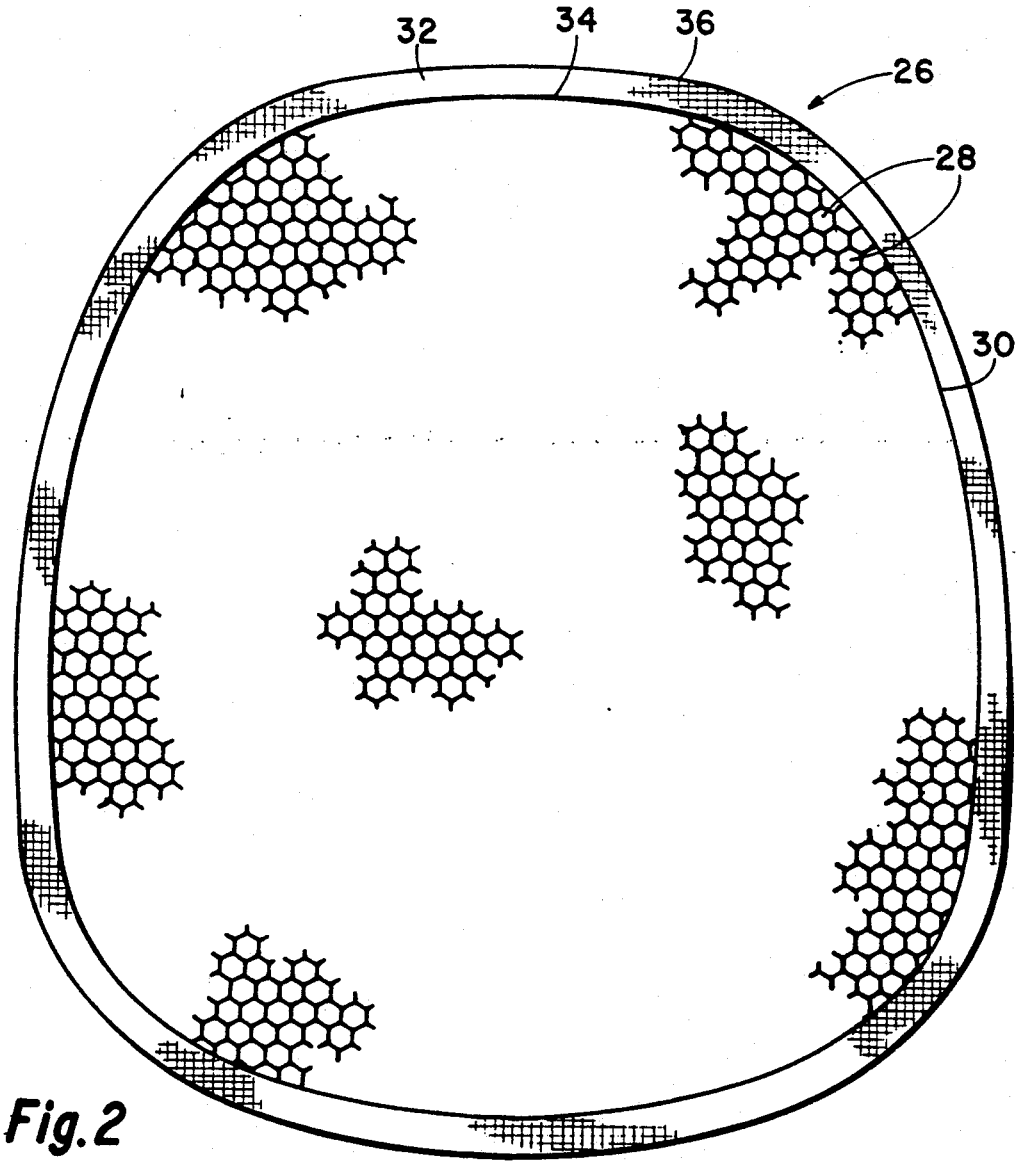
FIG. 2 is an enlarged view of the flexible open mesh member of this disclosure showing details of construction.
Figure 3:
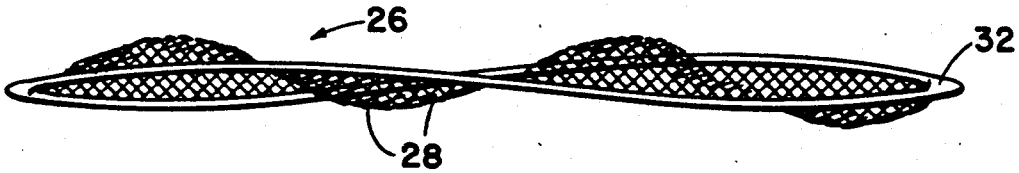
FIG. 3 is a side view of the flexible mesh member of this disclosure.

As seen in FIG. 2, mesh members 26 has openings 28 therein to allow water from the dishwasher water jets (not shown) to freely pass therethrough. Mesh member 26 may be formed of a light weight, flexible material, such as nylon or the like.

Figure 4:
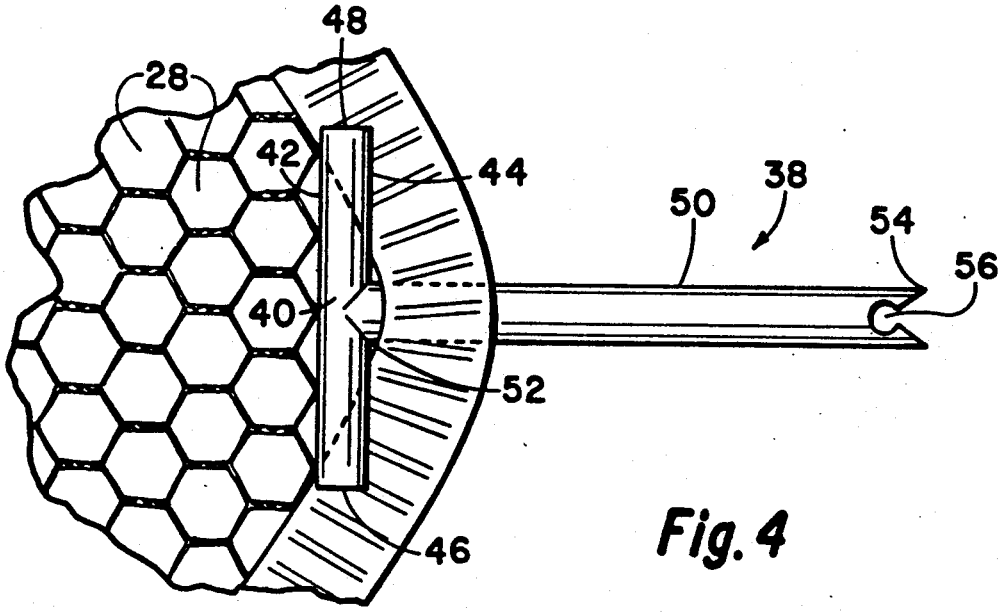
FIG. 4 is an elevational view of the T-pin member showing the member inserted through the flexible open mesh member opening and ready for attachment to the bottom wire member of the dishwasher basket.

Since bowls 24 or other similar objects are at a lower elevation than glasses 22, it can be seen that bowls 24 may be dislodged from their proper upside down position and for this reason T-pin members 38 are provided. As seen in FIG. 4, T-pin member 38 has an elongated slender body portion 50 having an upper end 52 and a lower end 54. An integrally slender elongated cross member 40 having an upper surface 42 and a lower surface 44, a first end 46 and a second end 48 is affixed to the upper end 52 extending normal to body portion 50. Elongated member 50 has its lower end 54 attachment means 56 for removable attachment to the basket bottom wire member 20. Attachment means 56 may be in the form of a cut away portion or key hole.

To further secure bowl 24 or other like items in its proper upside down position after mesh member is stretched across open top 21, T-pin members 50 are passed through an opening 28 in flexible mesh 26 adjacent to bowl 24 and clipped to basket wire support members 20 by cut away portion 56. Cross-member first and second end portions extend to either side of opening 28 and serve to secure mesh member 26 tightly around bowl 24 or other food preparation and serving articles and against upward dislodgement against the spray of water during washing action.

T-pin members 38 may be of varying lengths to accommodate a variety of sizes to food preparation and serving articles.

It can be seen that alternate means of securing mesh members 26 in place around basket 10 may be employed. An alternate means may be the use of the casing and draw string type arrangement (not shown) wherein border member 32 has an annular area therein providing means for holding or retaining a draw string. After mesh member 26 is stretched across open top rack 21 and around the peripheral edges thereof the draw string is then tightened and secured by a knot or the like. In this embodiment mesh member 26 may be dimensioned slightly larger than basket 10. T-pin members may be used to further secure items in the same magnet as referred to above.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with an open top generally rectangular wire basket as used in domestic automatic dishwashers in which the wire basket has a front and back, and opposed sides with a bottom formed of crossed, generally paralleled wire members, the basket being configured to receive food preparation and serving articles therein, such as cups, glasses, bowls, saucers and the like, for washing as water is sprayer upwardly through the basket in a dishwasher, the basket having an open top defined by an upper circumferential periphery of wire construction, an apparatus for holding such food preparation articles against dislodgement by the force of water spray during dishwashing action comprising:

a generally rectangular flexible open mesh member of dimension substantially corresponding to the upper circumferential periphery of automatic dishwasher basket and having a peripheral edge therearound;

an elastic, flexible border member secured to said open mesh member around the full peripheral edge thereof, the border member having a contracted circumferential length and an expandable circumferential length, the contracted circumferential length being less than the length of the upper circumferential periphery of the automatic dishwasher basket and the expandable circumferential length being greater than the length of the upper circumferential periphery of the automatic dishwasher whereby the border member may be placed around and secured to the exterior of the basket upper circumferential periphery to thereby retain said open said mesh member fully closing the basket open top whereby food preparation and serving articles are retained in the basket against the force of water sprayed through the basket; and at least one elongated T-pin member having an elongated slender body portion with an upper end and a lower end, an integral slender elongated cross-member affixed to the upper end extending normal to the body portion, and attachment means at the body portion lower end for removable attachment to a basket bottom forming wire members, the body portion being extendable through said open mesh member with the attachment means secured or a basket bottom forming wire member, the cross-member serving to downwardly restrain said open mesh member against upward dislodgement to thereby more effectively retain food preparation and serving articles in the basket against the spray of water during washing action.

2. An apparatus for use with a dishwasher basket according to claim 1 wherein said open mesh material is formed of lightweight nylon.

3. An apparatus for use with a dishwasher basket according to claim 1 wherein said T-pin attachment means is formed by a cut away portion on said body portion lower end dimensioned to removably clip onto a basket bottom forming wire member.

4. An apparatus for use with a dishwasher basket according to claim 1 wherein said T-pins are formed of varying lengths.

5. For use with an open top wire basket as used in domestic automatic dishwashers in which the basket has a front and back, and opposed sides with a bottom formed of crossed, generally paralleled wire member, and an open top defined by an upper circumferential periphery of wire construction, the basket being configured to receive food preparation and serving articles therein for washing as water is sprayed upwardly through the basket in a dishwasher, an apparatus for holding such food preparation and serving articles against the dislodgment by the force of water spray during washing action comprising:

a flexible open mesh member of dimension substantially corresponding to the upper circumferential periphery of the automatic dishwasher;

means of attaching said flexible open mesh member to the dishwasher basket; and at least one elongated T-pin member having an elongated slender body portion with an upper end and a lower end, an integrally cross-member affixed to the upper end extending normal to the body portion, and attachment means at the body portion lower end for removable attachment to a basket bottom forming wire members, the body portion being extendable through said open mesh member with the attachment means secured to a basket bottom forming wire member, the cross-member serving to downwardly restrain said open mesh member against upward dislodgment to thereby more effectively retain food preparation and serving articles in the basket against the spray of water during washing action.

6. An apparatus for use with an automatic dishwasher open top wire basket according to claim 5 wherein said means of attaching said flexible open mesh member to the dishwater basket includes:

a border member secured to said mesh member peripheral edge having a contracted circumferential length and an expandable circumferential length, the contracted circumferential length being less than the length of the upper circumferential periphery of the automatic dishwasher basket and the expandable circumferential length being greater than the length of the automatic dishwasher whereby the border member may be placed around and secured to the exterior of the basket upper circumferential periphery to thereby retain said open mesh fully closing the basket open top whereby food preparation and serving articles are retained in the basket against the force of water sprayed through the basket.

7. An apparatus for use with an automatic dishwasher open top wire basket according to claim 5 wherein said open mesh material is formed of lightweight nylon.

8. An apparatus for use with an automatic dishwasher open top wire basket according to claim 5 wherein said border means on said open mesh member periphery is formed of elastic material.

9. An apparatus for use with an automatic dishwasher open top wire basket according to claim 5 wherein said T-pin member attachment is formed of a cutaway portion on said body portion lower end dimensioned to removably clip onto a basket bottom forming wire member.

10. An apparatus for use with an automatic dishwasher open top wire basket according to claim 5 wherein said T-pin members are formed of varying lengths.

11. In combination with an open top generally rectangular wire basket as used in domestic automatic dishwashers in which the wire basket has a front and back, and opposed sides with a bottom formed of crossed, generally paralleled wire members, the basket being configured to receive food preparation and serving articles therein, such as cups, glasses, bowls, saucers and the like, for washing as water is sprayed upwardly through the basket in a dishwasher, the basket having an open top defined by an upper circumferential periphery of wire construction, apparatus for holding such food preparation articles against dislodgment by the force of water spray during washing action comprising:

a flexible open mesh positionable across said open top wire basket; and a T-pin member having an elongated slender body portion with an upper end and a lower end, an integrally slender elongated cross-member affixed to the upper end extending normal to the body portion, attachment means at said T-pin body portion lower end for removable attachment to a basket bottom forming wire member, the body portion being extendable through said open mesh member with the attachment means secured to a basket bottom forming wire member, the cross-member serving to downwardly restrain said open mesh member against upward dislodgment to thereby more effectively retain food preparation and serving articles in the basket against the spray of water during washing action.

12. The apparatus according to claim 11 wherein said T-pin attachment means is formed by a cut away portion on said body portion lower end dimensioned to removably clip onto a basket bottom forming wire member.

13. The apparatus according to claim 12 wherein said T-pins are formed of varying lengths.

* * * * *